United States Patent [19]

Davis et al.

[11] Patent Number: 4,898,329

[45] Date of Patent: Feb. 6, 1990

[54] APPARATUS FOR A FUEL SYSTEM

[75] Inventors: Franklin J. Davis, Glastonbury; Gilbert B. Wilcox, Somers; Richard R. Wright, Willimantic, all of Conn.

[73] Assignee: United Technologies Corporation, Hartford, Conn.

[21] Appl. No.: 117,117

[22] Filed: Nov. 4, 1987

[51] Int. Cl.[4] ..... B05B 1/24; B05B 17/04

[52] U.S. Cl. ..... 239/13; 239/397.5; 239/590.3; 239/600

[58] Field of Search ..... 239/13, 397.5, 600, 239/590.3, 553.3; 285/187, 905

[56] References Cited

U.S. PATENT DOCUMENTS

| | | | |
|---|---|---|---|
| 3,662,959 | 5/1972 | Sample, Jr. | 239/533 |
| 3,913,949 | 10/1975 | Senatro | 285/14 |
| 4,280,721 | 7/1981 | Narkon | 285/179 |
| 4,295,666 | 10/1981 | Melanson | 285/14 |
| 4,422,675 | 12/1983 | Norris et al. | 285/45 |
| 4,489,960 | 12/1984 | Senatro | 285/45 |
| 4,609,150 | 9/1986 | Pane, Jr. et al. | 239/397.5 |

*Primary Examiner*—Andres Kashnikow
*Assistant Examiner*—Michael J. Forman
*Attorney, Agent, or Firm*—Gene D. Fleischhauer

[57] ABSTRACT

A fuel nozzle assembly 32 which extends into a flow path 18 for working medium gases is disclosed. Various construction details which decrease the amount of heat transfer to the fuel are developed. The assembly includes an external heat shield 50 and an internal heat shield 98 which provide longitudinally overlapping insulating gaps 52, 102 between the fuel and the hot working medium gases. In particular, the insulating gap 52 extends to the inlet 94 of the fuel nozzle support.

11 Claims, 2 Drawing Sheets

FIG. 1
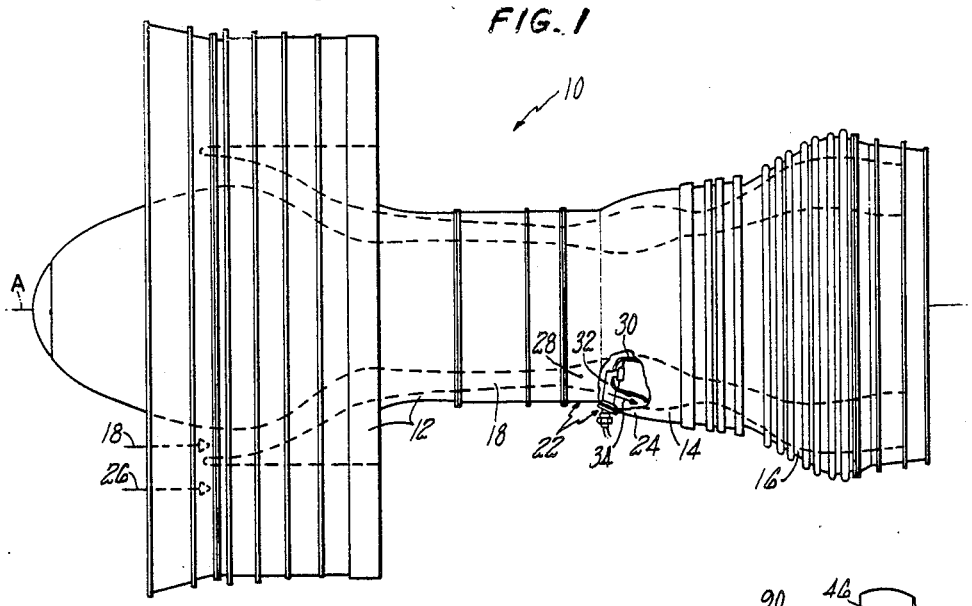
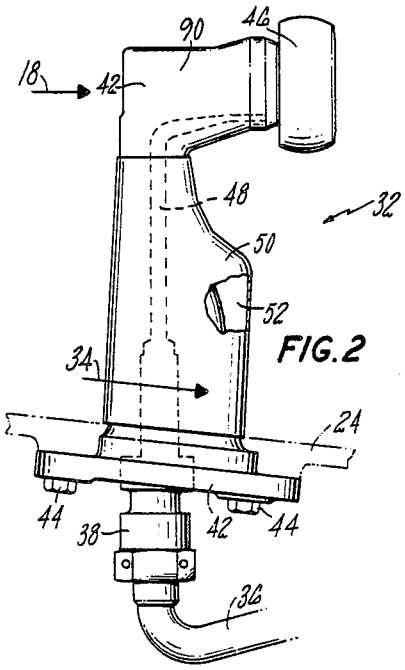
FIG. 2
FIG. 3
PRIOR ART
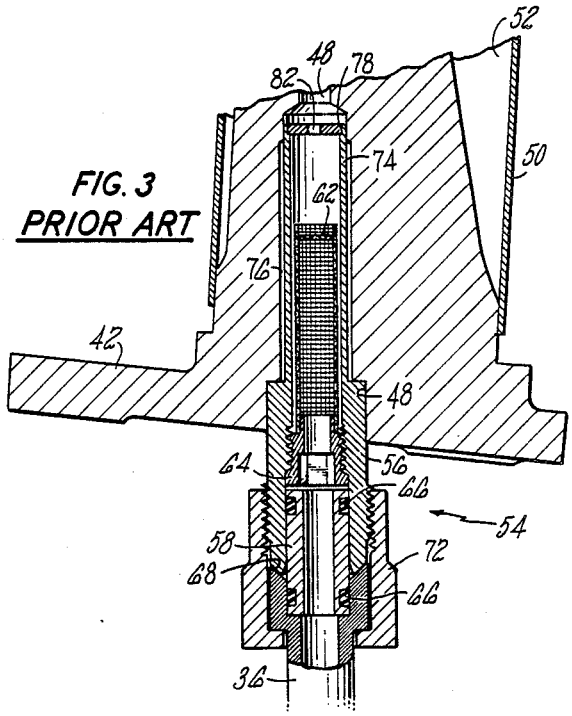

APPARATUS FOR A FUEL SYSTEM

DESCRIPTION

1. Technical Field

This invention relates to an apparatus for flowing fuel to a combustion chamber and more particularly to a fuel nozzle assembly for an axial flow rotary machine. Although this invention was developed in the field of gas turbine engines having a flow path for working medium gases, it is applicable to any machine having a flow path for hot gases.

2. Background of the Invention

An axial flow rotary machine, such as a gas turbine engine for an aircraft, is one example of a machine having a flow path for hot gases. Such an engine typically includes a compression section, a combustion section and a turbine section. An annular flow path for working medium gases extends axially through the sections of the engine. An engine casing extends axially through the engine and circumferentially about the flow path to bound the working medium flow path.

As the working medium gases are flowed along the flow path, the gases are compressed in the compression section causing the temperature and the pressure of the gases to rise. The temperature of the gases may exceed one thousand (1000) degrees Fahrenheit. The hot, pressurized gases are burned with fuel in the combustion section to add energy to the gases. These heated gases are expanded through the turbine section to produce useful work and thrust.

The combustion section includes a combustion chamber and a plurality of fuel nozzles for supplying fuel to the combustion chamber. The combustion chamber is annular in shape and has an upstream end which is adapted by openings to receive a major portion of the hot, working medium gases discharged from the compression section. The gases are mixed with the fuel (typically a combustible fluid such as JP4) and the gases and fuel are ignited to produce gases whose temperature can exceed twenty-five hundred (2500) degrees Fahrenheit.

A minor portion of the working medium gases discharged from the compression section are not flowed through the combustion chamber. These gases are flowed around the combustion chamber. Because these gases are not burned with fuel, the gases are relatively cool in comparison to the gases leaving the combustion chamber and entering the turbine section. These relatively cool gases are used to cool elements within the turbine section. Nevertheless as noted above, the temperature of these gases can exceed one thousand (1000) degrees Fahrenheit.

As a result of the relatively high temperature of these cooling gases with respect to the engine casing, heat is transferred by radiation and convection to the surrounding engine casing and to components which are attached to the casing. These components include components used to flow fuel to the fuel nozzle, such as the fuel line, the fuel nozzle support, and an inlet connector which adapts the fuel nozzle support to engage the fuel line.

The components which connect each fuel line to an associated fuel nozzle are critical links in the fuel supply system for the engine. Each component must be rigidly supported from the casing to insure vibrations do not cause leakage at the interface between adjacent components. And, yet the components must be insulated from the hot gases to avoid high temperatures which promote the formation of carbon (commonly called "coke") in the fuel. This carbon or coke can block narrow passages in the fuel supply system.

One device used to protect the fuel from high temperature is an external shield which is spaced from the fuel nozzle support. The shield blocks heat transfer by radiation from the hot gases to the fuel nozzle support. The shield also provides an insulating gap to the fuel nozzle support to decrease the amount of heat transfer by convection.

Other devices have been used to shield the fuel from the high temperature environment of the engine. For example, FIG. 3 is a simplified drawing of a fuel nozzle assembly 54 having an improved inlet connector 56. This fuel nozzle assembly 54 was supplied slightly more than a year ago with engines sold by Applicants Assignee. The fuel nozzle assembly 54 includes a fuel nozzle 46 (not shown), a fuel nozzle support 42, and a passage 48 for fuel extending through the fuel nozzle support. The inlet connector 54, a transfer tube 58 and a fuel strainer 62 (screen) are disposed within the passage. The inlet connector is brazed to the fuel nozzle support. The fuel screen is supported by a conical sealing element 64 which engages the inlet connector.

The transfer tube 58 is a cylindrical member having two elastomeric 0-ring seals 66, one engaging the inlet connector and the other engaging the fuel line. The transfer tube provides a bridge between the fuel line and the inlet connector to block the leakage of fuel at this interface.

The fuel line is adapted by a conical surface 68 to engage the inlet connector 56 to provide a second tube in parallel with the transfer tube to block the leakage of fuel from the points where the transfer tube engages the connector and fuel line. A fuel nozzle nut 72 urges the fuel line and the connector together to insure the sealing surfaces engaged.

The improved inlet connector further includes a heat shield 74 formed integrally with the connector and spaced inwardly from the fuel nozzle support to provide an internal insulating gap 76. The internal insulating gap overlaps the external insulating gap 52 between the heat shield 50 and the fuel nozzle support. The downstream end 78 of the connector-heat shield slidably engages the fuel nozzle support and has an orifice 82 disposed within the shield for controlling the flow of fuel to the fuel nozzle.

The above improvement notwithstanding, scientists and engineers under the direction of Applicants Assignee have been working to improve fuel nozzle assemblies and particularly components between the fuel line and the fuel nozzle to reduce coking while providing a connection which blocks the leakage of fuel without increasing the radial profile of the inlet assembly.

Disclosure of Invention

This invention is predicated on the recognition that heat transfer from the working medium gases through the casing and the fuel nozzle support significantly increases wall temperatures in the inlet connector. The situation is especially of concern under conditions which occur when fuel flow is rapidly decreasing while the temperature of the casing remains high such as during the brief period when the engine is decelerated from a condition of high power.

According to the present invention, a fuel nozzle assembly having a passage for fuel and an external heat shield includes an internal heat shield disposed in the fuel passage which is spaced inwardly from the support leaving an internal insulating gap therebetween that overlaps the external shield and extends to the inlet of the fuel passage to block the transfer of heat from the fuel nozzle support to the fuel.

In accordance with the present invention, an inlet connector engages the fuel nozzle support and has a midsection which positions one end of the heat shield; the midsection has a reduced cross-sectional volume and area and extends longitudinally beyond the fuel nozzle support to a location where it is cooled externally by air flowing over the connector and internally by fuel flowing through the connector.

In accordance with the present invention, a method for shielding the fuel flowing through a passage in a fuel nozzle assembly includes the steps of: shielding the fuel stream with an insulating gap outwardly of the passage; and shielding the passage with an internal insulating gap which longitudinally overlaps the external gap and extends longitudinally to the entrance to the passage.

A primary feature of the present invention is a fuel nozzle assembly which includes a fuel nozzle and a support for the fuel nozzle. A passage for fuel extends through the fuel nozzle support from an inlet in the support. An external heat shield is spaced from the fuel nozzle support leaving an insulating gap therebetween. Another principal feature is an internal heat shield which overlaps longitudinally the external heat shield. Another feature is an inlet connector which is fixed to the fuel nozzle support. The inlet connector has a passage in flow communication with the passage in the fuel nozzle support.

In one embodiment, the internal heat shield extends into the inlet connector passage and is spaced from the inlet connector and the fuel nozzle support leaving an internal insulating gap therebetween which extends to the fuel inlet of the fuel nozzle support. In one particular embodiment, the inlet connector has a base section, a midsection and an inlet section. The midsection engages one end of the internal heat shield. The midsection has a reduced cross sectional area in comparison to the base section.

The heat shield is supported by slidably engaging the midsection. The heat shield is supported at the other end by being integrally attached to the fuel nozzle support and a flow control orifice is disposed at that end of the heat shield. Still another feature is a one-piece transfer tube and screen assembly which has a first conical seat that blocks the leakage of fuel from a point downstream of the screen. A second conical seat in the inlet connector upstream of the first conical seat further blocks the loss of fuel from the fuel nozzle.

A principal advantage of the present invention is the engine efficiency which results from the even distribution of fuel through passages to the combustion chamber. Blockage of these passages is reduced by reducing coking in the fuel as the fuel passes through the fuel nozzle assembly. In particular, the temperature profile of the wall bounding the fuel flow in the inlet connector and in the fuel nozzle support is decreased in comparison with constructions which do not have an air gap which extends to the inlet of the fuel nozzle support. In one embodiment, an advantage is the temperature profile of the wall which results from increasing the thermal resistance of the conduction path to the fuel in the inlet connector by decreasing the heat transfer area and the continuity of the path to the fuel with a slidable contact between the heat shield and the connector. The temperature profile is further improved under engine operating conditions at which low fuel flow is accompanied by high working medium gas temperature by supporting the heat shield with the midsection of the connector that has a relatively small thermal capacitance in comparison to the base section and external cooling. Another advantage of the present invention is reduced stress at the interface between the inlet connector and the fuel nozzle support which results from decreasing the unit stress and the thermal gradient in the base section of the connector by enlarging the base section of the inlet connector which engages the fuel nozzle support.

The foregoing features and advantages of the present invention will become more apparent in light of the following detailed description of the best mode for carrying out the invention and in the accompanying drawings.

BRIEF DESCRIPTION OF DRAWINGS

FIG. 1 is a side elevation view of an axial flow rotary machine showing a flow path for working medium gases in phantom with a portion of the engine casing broken away to show an annular combustion chamber and a fuel nozzle assembly.

FIG. 2 is an enlarged view of a portion of FIG. 1 showing an inlet fuel line and fuel nozzle assembly of the present invention.

FIG. 3 is an enlarged cross sectional view of a portion of a fuel nozzle assembly which is prior art.

BEST MODE FOR CARRYING OUT THE INVENTION

Figure 4:
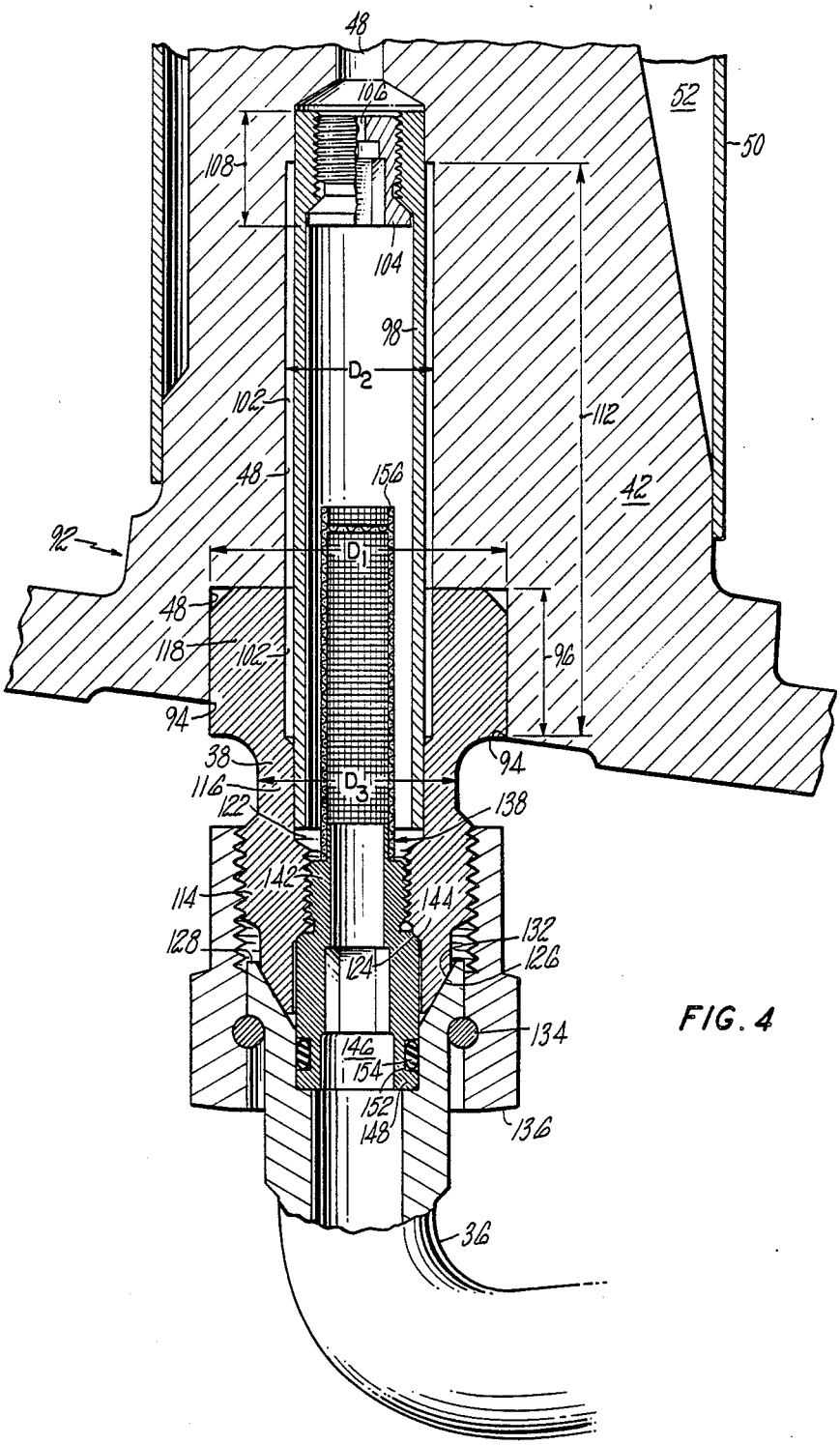
FIG. 4 is an enlarged cross sectional view of a portion of the fuel nozzle assembly shown in FIG. 2 showing in more detail the fuel line, the inlet connector and fuel nozzle support.

FIG. 1 is a side elevation view of an axial flow gas turbine engine 10 of the turbofan type. The engine has an axis A. A compression section 12, a combustion section 14 and a turbine section 16 are disposed circumferentially about the axis A. An annular flow path 18 for primary working medium gases extends circumferentially about the axis A and rearwardly through the sections of the engine. The flow path is shown in phantom. A stator assembly 22 includes an outer casing 24. The outer casing extends circumferentially about the flow path and rearwardly through the engine to bound the working medium flow path. An annular flow path 26 for working medium gases, commonly called the secondary or the bypass flow path, is radially outwardly of the primary flow path and extends rearwardly about the combustion and turbine sections.

The exit of the compression section 12 of the engine includes a diffuser region 28 which is immediately upstream of the combustion section 14. An annular combustion chamber 30 in the combustion section extends circumferentially about the axis of the engine downstream of the diffuser region. The combustion chamber is adapted by openings (not shown) to receive hot, pressurized gases from the diffuser region of the compression section. A plurality of fuel nozzle assemblies, as represented by the single fuel nozzle assembly 32, extend radially inwardly across the working medium flow path 18 to the annular combustion section. A portion of the working medium gases from the diffuser section are bypassed around the combustion section along a flow path 34 for cooling air. The cooling air is flowed downstream to the turbine section along the cooling air flow path to cool components of the turbine section FIG. 2 is an enlarged view of the engine casing 24 and the fuel nozzle assembly 32 shown in FIG. 1. A fuel line 36 in flow communication with a source of fuel (not shown) is attached to the fuel nozzle assembly. The fuel nozzle assembly includes an inlet connector 38 which is attached to the fuel line. A fuel nozzle support 42 is adapted to engage the inlet connector. The fuel nozzle support is attached by bolts 44 to the engine casing and extends inwardly from the casing in a generally radial direction. A fuel nozzle 46 is attached to the fuel nozzle support and extends in a generally axial direction. The fuel nozzle is adapted by openings (not shown) to discharge fuel and mix the fuel with working medium gases to form a combustible mixture. The fuel nozzle support is adapted by a passage 48 shown in phantom to place the fuel nozzle in flow communication with the fuel line. An external heat shield 50 is disposed about the fuel nozzle support to shield a portion of the fuel nozzle support from the hot working medium gases. The heat shield is spaced transversely from the fuel nozzle support to leave an external insulating gap 52 therebetween. The heat shield is formed of a nickel base alloy, AMS (Aerospace Material Specifications) 5512.

FIG. 3 is the prior att construction discussed earlier in the "Background of Invention" section of this application.

FIG. 4 is an enlarged cross sectional view of a portion of the fuel nozzle assembly of FIG. 2 showing in more detail the fuel line 36, the inlet connector 38 and the fuel nozzle support 42. The fuel nozzle support has a first end 90 shown in FIG. 2 which positions the fuel nozzle. The support has a second end 92 which is adapted by an inlet 94 to pass fuel. The second end has an inlet region 96 extending about and longitudinally from the inlet. The passage 48 for fuel extends from the inlet 94 of the fuel nozzle support 42 through the support in the longitudinal or length wise direction of the support to place the fuel nozzle in flow communication with a source of fuel.

An internal heat shield 98 is disposed in the passage 48. The heat shield is formed of a stainless steel alloy, AMS (Aerospace Material Specification) 5645. The heat shield is spaced from the inlet connector and the fuel nozzle support 42 leaving an internal insulating (air) gap 102 therebetween. An orifice plug 104 is disposed in the heat shield and has an orifice 106. The fuel nozzle support has an orifice region 108 extending about the orifice plug. An insulating gap region 112 extends from the inlet through the inlet region 96 and between the inlet region and the orifice region and into the orifice region.

The passage 48 has a first diameter $D_1$ and associated cross-sectional area in the inlet region which adapts the support to receive the inlet connector 38. The passage has a second diameter $D_2$ and associated cross-sectional area in the insulating gap region which is smaller than the diameter $D_1$ and first cross-sectional area.

The inlet connector 38 is integrally joined to the fuel nozzle support 42. The inlet connector has an inlet section 114, a midsection 116 of diameter $D_3$ and a base section 118. The base section has an enlarged diameter $D_1$, cross sectional area $A_1$ and a large surface area in comparison with to remainder of the connector. The base section is disposed in the inlet region 96 of the fuel nozzle support and is fixed to the support, such as by brazing. The midsection extends from the inlet section to the base section and has a reduced diameter $D_3$ cross-sectional area $A_3$ in comparison to the cross sectional area $A_1$ of the base section but is larger than the diameter $D_2$ of the downstream passage. The midsection is spaced from the fuel nozzle support over at least a portion of the midsection's circumference and is exposed to cooling air in the nacelle region of the engine over the entire surface of the midsection.

A passage 122 for fuel extends through the inlet connector 38 and places the inlet connector in flow communication with the passage 48 for fuel in the fuel nozzle support and in flow communication with the fuel line 36. The inlet connector has an outwardly facing conical seal seat 124 which extends about the interior of the passage. The inlet connector has a second outwardly facing conical seal seat 126 which extends about the exterior of the inlet connector.

The seal seats 124, 126 adapt the inlet connector to form seals with abutting elements For example, the fuel line 36 has a tapered end piece 128 having a conical surface 132 which engages with the outwardly facing seal seat extending about the exterior of the inlet connector. A lock wire 134 and nut 136 engage the end of the fuel line to urge the conical surface of the fuel line against the conical seat of the inlet connector.

Similarly, a transfer tube assembly 138 is disposed in the passage 122 of the inlet connector. The transfer tube assembly includes a transfer tube 142 having a conical surface 144 which engages the internal seal seat 124 of the inlet connector. The transfer tube has a passage 146 for allowing fuel to flow from the fuel line to the passage 122 in the inlet connector. The transfer tube has a flange 148 at one end which extends from the connector. The flange has a sealing grove 152 extending about the exterior of the tube. An elastomeric seal 154, such as an 0-ring, adapts the transfer tube to engage the interior of the fuel supply element, fuel line 36.

The transfer tube assembly 138 includes a fuel strainer 156 or screen which is integrally attached to the transfer tube 142 by brazing. The screen, which is disposed in the inlet connector passage 122, permits flow communication between the passage 146 in the transfer tube and the passages 122, 48 in the inlet connector and the fuel nozzle support 42 while removing any large size contaminants from the fuel.

The internal heat shield 98 is disposed in the inlet connector passage 122 and in the passage 48 which extends through the fuel nozzle support. The internal shield is fixed, such as by brazing, at the downstream end to the fuel nozzle support. This permits changing the orifice plug by unscrewing the existing plug and inserting a new plug.

As noted before, the internal shield 98 is spaced from the full nozzle support 42 and the inlet connector 38 in the region between the midsection 116 of the connector and the orifice region 108 of the fuel nozzle support. This leaves the internal insulating gap 102 between the shield and the fuel nozzle support. The insulating gap extends through the inlet region 96 to the inlet 94 of the fuel nozzle support and through the insulating gap region 112 upstream of the orifice region 108. As can be seen, the internal heat shield and its insulating gap overlap longitudinally the external insulating gap 52 and extend longitudinally to the inlet 94 of the fuel nozzle support. The internal heat shield slidably engages the midsection of the connector to permit differences in relative thermal growth between the heat shield and the inlet connector and between the heat shield and the fuel nozzle support.

During operation of the gas turbine engine shown in FIG. 1, working medium gases are flowed along the working medium flow path 18. As the gases exit the compression 12 section and pass through the diffuser region 28, the gases are compressed and can reach temperatures in excess of 1000° Fahrenheit.

As the hot gases pass along the casing 24 and over the inwardly facing portion of the fuel nozzle support 42, the external heat shield 50 blocks the hot gases from contacting a substantial portion of the fuel nozzle support. Nevertheless, heat is transferred from the gases to the casing causing temperatures of five hundred (500° ) Fahrenheit or more in the casing and the casing portion of the fuel nozzle support. Heat is conducted via the casing and through the fuel nozzle support to the inlet connector 38. Heat is lost from the connector by radiation, by convection to the air surrounding the engine and by convection to the fuel flowing through the inlet connector. As a result, a temperature or thermal gradient is established in the inlet connector. The effect of the thermal gradient where the inlet connector is attached to the fuel nozzle support (primarily thermal stresses) is reduced by the large cross-sectional area and surface area of the base section 118 of the inlet connector.

Within the inlet connector 38, heat is transferred by conduction from the base section 118 to the midsection 116 and thence to the upstream end of the heat shield 98. As the fuel flows through the inlet connector, it contacts the walls of the transfer tube 142, the midsection of the inlet connector and the heat shield along its length. The insulating gap 102 isolates the flowing fuel from contacting directly the fuel nozzle support in regions of the fuel nozzle support where the hot working medium gases directly contact the fuel nozzle support.

And, it isolates the fuel from contacting the base section 118 of the inlet connector 38 which receives heat from these regions of the fuel nozzle support 42. The only direct path for heat transfer to the fuel from the fuel nozzle support through the inlet connector lies through the midsection of the inlet connector. Because of the midsection's reduced area and the slidable connection between the midsection and the heat shield, the thermal resistance along this heat transfer path is greater than if the heat shield engaged the base section 118 of the connector. As a result, the temperature of the wall is greatly reduced in comparison to configurations where the heat can flow directly from the casing through the fuel nozzle support to the inlet connector and thence through the base section and heat shield to the fuel.

A second advantage occurs from spacing the zone of engagement between the heat shield 98 and the midsection 116 from the fuel nozzle support 42. Under certain operating conditions of the aircraft the fuel flow is rapidly decreased, such as when the engine throttle moves from a high power setting to a low power setting. The decrease in fuel flow is nearly instantaneous while the temperature of the casing more slowly follows by reason of the thermal capacitance of the casing. As a result, the casing remains hot while the fuel flow, which cools the inlet connector and the heat shield, is greatly decreased. By reason of the reduced area and volume of the midsection, the thermal capacitance of the midsection is relatively small. Accordingly, the midsection is more quickly cooled by the fuel to minimize any adverse affect that reduced fuel flow can have on the temperature of the midsection under transient engine operating conditions.

Finally, even if fuel should enter the insulating gap 102 between the heat shield 98 and the fuel nozzle support 42, the fuel would have a lower coefficient of thermal conductivity than the metal of either the inlet connector or the fuel nozzle support and would still provide an insulating effect to the fuel flowing through the fuel nozzle assembly.

Although the invention has been shown and described with respect to detailed embodiments thereof, it should be understood by those skilled in the art that various changes in form and detail thereof may be made without departing from the spirit and the scope of the claimed invention.

We claim:

1. A fuel nozzle assembly for a machine for the type which is adapted to extend into a flow path for working medium gases, wherein the improvement comprises:

a fuel nozzle, a support for the fuel nozzle, the support having an external surface, an inlet, and an internal surface bounding a passage for fuel which has a longitudinal dimension and which extends from the inlet through the support, an external heat shield spaced from the support to leave an external insulating gap therebetween which extends longitudinally with respect to and outwardly of at least a portion of the passage, an internal heat shield which is disposed within said passage and which is spaced from the internal surface of the support leaving an internal insulating gap therebetween which longitudinally overlaps the external insulating gap and extends to at least an upstreammost edge of the inlet of the fuel nozzle support.

2. The fuel nozzle assembly of claim 1 wherein the internal heat shield has a first end and a second end, wherein the fuel nozzle assembly includes an inlet connector for flowing fuel which has an upstream end and a downstream end, the inlet connector being integrally attached to the fuel nozzle, and having a passage for fuel, the passage in the inlet connector having a longitudinal direction, the passage being in flow communication with the passage in the fuel nozzle support, the inlet connector having a midsection having a region for positioning the second end of the internal heat shield, the region of the midsection being spaced longitudinally from the fuel nozzle support and wherein the internal heat shield extends past the downstream end of the connector in the connector passage to the midsection and is engaged by the midsection.

3. The fuel nozzle of claim 2 wherein the exterior of the midsection of the connector is surrounded by cooling air.

4. The fuel nozzle assembly of claim 3 wherein the inlet connector has a base section which extends from the midsection and which is engaged by the fuel nozzle support and wherein the midsection has a cross-section area which is smaller than the cross-section area of the base section.

5. The fuel nozzle assembly of claim 4 wherein the inlet connector has an inlet section which extends from the midsection and which includes a conical seat extending about the interior of the inlet section wherein the fuel nozzle assembly includes a one-piece transfer tube and screen and wherein the transfer tube is disposed in the passage in the inlet connector and engage the inlet connector at the conical seat in the inlet section.

6. The fuel nozzle assembly of claim 1 wherein the midsection slidably engages the internal heat shield.

7. The fuel assembly of claim 6 wherein the exterior of the midsection of the connector is surrounded by cooling air.

8. The fuel nozzle assembly of claim 7 wherein the inlet connector has a base section which extends from the midsection and which is engaged by the fuel nozzle support and wherein the midsection has a cross-sectional area which is smaller than the cross-sectional area of the base section.

9. The fuel assembly of claim 8 wherein the inlet connector has an inlet section which extends from the midsection and which includes a conical seat extending about the interior of the inlet section wherein the fuel nozzle assembly includes a one-piece transfer tube and screen and wherein the transfer tube is disposed in the passage in the inlet connector and engages the inlet connector at the conical seat in the inlet section.

10. A fuel nozzle assembly for a rotary machine which is adapted to extend into a flow path for hot working medium gases, the fuel nozzle assembly including:

a fuel nozzle;

a support for the fuel nozzle having a first end which positions the fuel nozzle, a second end which is adapted by an inlet to pass fuel, the second end having an inlet region, an orifice region and an internal insulating gap region extending between the inlet region and the orifice region, a passage for fuel extending from the inlet through the support to place the fuel nozzle in flow communication with a source of fuel, the passage extending longitudinally through the second end, the passage having a first cross-sectional area in the inlet region which adaps the support to receive an inlet connector, and the passage having a second cross-sectional area in the internal insulating gap region which is smaller than the first cross-sectional area;

an inlet connector having a passage for fuel in flow communication with the passage in the support, the inlet connector further having, a base section which has a cross-sectional area $A_1$, which is disposed in the inlet region of the support and which is fixed to the support, an inlet section which is spaced from the support having an outwardly facing internal seal seat extending about the exterior of the passage and an outwardly facing seal extending about the exterior of the inlet connector and, a midsection which extends between the inlet section and the base section and which has a cross-sectional area $A_2$, which is smaller than the cross-sectional area $A_1$;

a tube assembly including a tube having a passage therethrough disposed in the passage of the inlet connector, the tube having a first end and a second end, a seal seat which engages the internal seal seat of the inlet connector, the tube having a flange at the first end which extends from the connector, the flange having a seal extending about the exterior of the tube which adapts the tube to engage the interior of a fuel supply element and, a screen which is attached to the second end of the tube assembly and which is disposed in the connector passage permitting flow communication between the passage in the tube and the passages in the connector and the support;

an external shield which extends about the exterior of the support and is spaced from the support leaving an external insulating gap therebetween which overlaps longitudinally the internal insulating gap region;

an internal shield disposed in the connector passage and the support passage, the internal shield having an orifice disposed within the orifice region of the support, the internal shield being spaced from the inlet connector and the support leaving an internal insulating gap therebetween upstream of the orifice region;

wherein the internal insulating gap overlaps longitudinally the external insulating gap and extends longitudinally to the inlet of the support, wherein the internal shield is fixed to the support in the orifice region and slidably engages the midsection of the connector.

11. A method for shielding fuel flowing through a passage in a fuel nozzle assembly of a gas turbine engine, the passage having a longitudinal dimension, the engine having a fuel nozzle support which is attached to a casing of the engine and which has an inlet for said passage said inlet being at an upstreammost edge of said fuel nozzle support, which includes the steps of:

shielding the fuel stream with a longitudinally extending insulating gap outwardly of the passage; and, shielding the passage with an internal insulating gap internally of the passage which longitudinally overlaps the external gap and extends longitudinally to at least said upstreammost edge of the inlet to the passage.

* * * * *